US006659162B2

(12) United States Patent
Frommeyer et al.

(10) Patent No.: US 6,659,162 B2
(45) Date of Patent: Dec. 9, 2003

(54) PRODUCTION OF LARGE-AREA METALLIC INTEGRAL FOAMS

(75) Inventors: Georg Frommeyer, Erkrath (DE); Wilfried Knott, Essen (DE); Manfred Recksik, Essen (DE); Andreas Weier, Essen (DE)

(73) Assignee: Goldschmidt AG, Essen (DE)

( * ) Notice: Subject to any disclaimer, the term of this patent is extended or adjusted under 35 U.S.C. 154(b) by 0 days.

(21) Appl. No.: 10/060,589

(22) Filed: Jan. 30, 2002

(65) Prior Publication Data

US 2002/0112838 A1 Aug. 22, 2002

(30) Foreign Application Priority Data

Feb. 1, 2001 (DE) ..... 101 04 338

(51) Int. Cl.[7] ..... B22D 27/00; B22D 11/06
(52) U.S. Cl. ..... 164/79; 164/428; 164/480
(58) Field of Search ..... 164/79, 428

(56) References Cited

U.S. PATENT DOCUMENTS

| | | | | |
|---|---|---|---|---|
| 3,005,700 A | * | 10/1961 | Elliott | 164/475 |
| 4,314,835 A | * | 2/1982 | Pelton | 65/22 |
| 5,334,236 A | * | 8/1994 | Sang et al. | 75/415 |
| 5,632,319 A | * | 5/1997 | Yang et al. | 164/79 |
| 5,972,285 A | * | 10/1999 | Knott | 419/2 |

FOREIGN PATENT DOCUMENTS

| | | | |
|---|---|---|---|
| DE | 1 164 103 | | 11/1960 |
| DE | 195 01 508 C1 | | 4/1996 |
| DE | D 197 44 300 A1 | | 4/1998 |
| DE | 198 32 794 | | 10/1999 |
| GB | 892934 | | 4/1962 |
| JP | 62020846 A | * | 1/1987 |
| JP | 3-17236 | | 1/1991 |
| JP | 7-145435 | | 6/1995 |
| JP | 9-241780 | | 9/1997 |
| JP | 09241780 A | * | 9/1997 |
| WO | WO 92/21457 | | 12/1992 |

OTHER PUBLICATIONS

Usla et al, Ti–6A1–4V Hollow Sphere Foams, School of Materials Science and Engineering, 1997, pp. 289–300.

Guiping et al, "An Approach to the Factors Influencing the Preparation of Foam Metal by Infiltration Method"; Feb. 1997, pp. 1–4.

Dr.–Ing. W. Thiele, "Füllstoffhaltiger Aluminium-schwamm–ein kompressibler Guβwerkstoff zur Absorption von Stoβenergie", METALL, 28, Jahrgang, Jan. 1974, Heft 1; pp. 39–42.

* cited by examiner

*Primary Examiner*—M. Alexandra Elve
*Assistant Examiner*—Kevin McHenry
(74) *Attorney, Agent, or Firm*—Frommer Lawrence & Haug LLP

(57) ABSTRACT

The invention relates to a process for producing metal foams and to the metal bodies in foam form which are obtained in this way.

The process for producing large-area integral metal foam by adding a blowing agent to a metal melt, is distinguished by the fact that the metal melt is introduced continuously into a roll nip and is brought into contact with a blowing agent which releases gases and is solid at room temperature, is formed in the roll stand and is fully foamed to form a large-area integral metal foam.

11 Claims, No Drawings

PRODUCTION OF LARGE-AREA METALLIC INTEGRAL FOAMS

RELATED APPLICATIONS

This application claims priority to German application no. 101 04 338.4 A filed Feb. 1, 2001, herein incorporated by reference.

BACKGROUND OF THE INVENTION

1. Field of the Invention

The invention relates to a process for producing metal foams and to the metal bodies in foam form which are obtained in this way.

2. Description of the Related Art

The prior art for the production of metal foams substantially comprises five basic procedures:

1. the compacting of metal powders with suitable blowing agents and heating of the preforms obtained in this way to temperatures which are higher than the liquidus temperature of the metal matrix and higher than the decomposition temperature of the blowing agent used;
2. dissolving or blowing of blowing gases into metal melts;
3. stirring of blowing agents into metal melts;
4. sintering of metallic hollow spheres;
5. infiltration of metal melts into filler bodies, which are removed after the melt has solidified.

Regarding the first procedure DE-A-197 44 300 deals with the production and use of porous light metal parts or light-metal alloy parts, the bodies which have been compressed from a powder mixture (light-metal or Al alloy and blowing agent) being heated, in a heatable, closed vessel with inlet and outlet openings, to temperatures which are higher than the decomposition temperature of the blowing agent and/or melting temperature of the metal or of the alloy.

Regarding the second procedure JP 03017236A describes a process for producing metallic articles with cavities by dissolving gases in a metal melt and then initiating the foaming operation by suddenly reducing the pressure. Cooling of the melt stabilizes the foam obtained in this way.

WO 92/21457 teaches the production of Al foam or Al alloy foam by blowing in gas beneath the surface of a molten metal, abrasives, such as for example SiC, $ZrO_2$ etc., being used as stabilizers.

With respect to the third procedure, according to the teaching given in JP 09241780 A, metallic foams are obtained with the controlled release of blowing gases as a result of the metals initially being melted at temperatures which lie below the decomposition temperature of the blowing agent used. Subsequent dispersion of the blowing agent in the molten metal and heating of the matrix to above the temperature which is then required to release blowing gases leads to a metal foam being formed.

Regarding the fourth procedure, the production of ultralight Ti-6Al-4V hollow sphere foams is based on the sintering, which takes place at temperatures of ≧1000° C., of hydrated Ti-6Al-4V hollow spheres at 600° C. (Synth./Process. Lightweight Met. Mater. II, Proc. Symp. 2nd (1997),289–300).

With respect to procedure 5, foamed aluminum is obtained by, after infiltration of molten aluminum into a porous filler, by removal of the filler from the solidified metal (Thuzao Bianjibu (1997) (2) 1–4; ZHUZET, ISSN: 1001-4977).

Furthermore, components with a hollow profiled section are of particular interest for reducing weight and increasing rigidity. DE-A-195 01 508 deals with a component for the chassis of a motor vehicle which comprises die-cast aluminum and has a hollow profiled section, in the interior of which there is a core of aluminum foam. The integrated aluminum foam core is produced in advance by powder metallurgy and is then fixed to the inner wall of a casting die and surrounded with metal by die-casting.

W. Thiele: Fullstoffihaltiger Aluminiumschwamm—ein kompressibler Gusswerkstoff zur Absorption von Stoβenergic, [Filler-containing aluminum sponge—a compressible cast material for absorption of impact energy], in: Metall 28, 1974, Vol. 1, pp. 39 to 42, describes the production of foamed aluminum. The desired cavities are predetermined in terms of size, shape and position in the form of a loose bed of readily compressible, inorganic light materials, such as for example expanded clay minerals, expanded clay, glass foam beads or hollow corundum beads, etc. The bed of light material is introduced into a die. The spaces which remain in the bed are filled with metal. The aluminum sponge obtained in this way has relatively poor mechanical qualities and contains the material of the bed.

JP Patent Abstracts of Japan: JP 09241780 A describes the production of metallic foam bodies. In particular, metals or alloys are melted under atmospheric pressure and are mixed with a small amount of titanium hydride. Titanium hydride is uniformly distributed in the molten metal by stirring and, in a further step, the metal is cast into a die or a metal product. The molten metal in the die is heated again, to a temperature which is higher than the melting point of the metals or alloys, with the result that the foaming reaction takes place.

DE-B-11 64 103 describes a process for producing metal foam bodies. In this process, a solid material which, when heated, decomposes to form gases, is mixed with a molten metal in such a manner that the solid material is wetted by the metal. By way of example, pulverulent titanium hydride is added to a molten alloy of aluminum and magnesium at a temperature of 600° C. The closed foam formed in this way is then cast into a die, where it can cool and solidify. In this case too, it is clearly not a closed system, but rather an open system which is used.

GB-A-892 934 describes the production of complex structures with foamed metal core and continuous, nonporous surface.

DE-C 198 32 794 describes a process for producing a hollow profiled section which is filled with metal foam. This process comprises the steps of extruding the hollow profiled section from a sheathing material using an extruder which has an extrusion die with a die part and a mandrel, supplying the metal foam from a foam material to the hollow profiled section through a feed duct, which is formed in the mandrel.

JP Patent Abstracts of Japan 07145435 A describes the production of foamed metal wires. Molten aluminum is foamed in a furnace with the aid of a blowing agent and is fed to a continuous casting device. The molten aluminum in the foamed state is cooled between a pair of upper and lower conveyor belts in order to obtain an endless strand. This strand is cut into the foamed aluminum wires in a predetermined way. Alternatively, the foamed aluminum wire or the strand can be formed by drawing the foamed, molten aluminum between a wire with a groove and a conveyor belt. The molten aluminum wire is therefore obtained by rolling or drawing.

When assessing the prior art, it can be observed that the processes which provide for preliminary compacting of preforms which contain blowing agent are complex and expensive and are unsuitable for mass production. Moreover, a common feature of these processes is that the desired temperature difference between the melting point of the metal which is to be foamed and the decomposition temperature of the blowing agent used should be as low as possible, since otherwise disruptive decomposition of blowing agent takes place even during compacting or later in the melting phase. This observation applies in a similar way to the introduction of blowing agents into metal melts.

The sintering of preformed hollow spheres to form a metallic foam is at best of academic interest, since even the production of the hollow spheres requires a complex procedure.

The infiltration technique has to be considered in a similar way, since the porous filler has to be removed from the foam matrix, which is a difficult operation.

The dissolving or blowing of blowing gases into metal melts is not suitable for the production of near net shape components, since a system comprising melt with occluded gas bubbles is not stable for a sufficient time for it to be processed in shaping dies.

OBJECT OF THE INVENTION

In view of this background, it was an object of the invention to provide for a simple process which produces large-area metallic integral foams with a continuous outer skin which is suitable for mass production, allows the production of near net shape parts with little outlay and is based on the use of solid blowing agents which release gases.

DESCRIPTION OF THE INVENTION

In a first embodiment, the above object is achieved by a process for producing large-area integral metal foam by adding a blowing agent to a metal melt, which is distinguished by the fact that the metal melt is introduced continuously into a roll nip and is brought into contact with a blowing agent which releases gases and is solid at room temperature, is formed in the roll stand and is fully foamed to form a large-area integral metal foam.

Amazingly, it has been discovered that, in particular, light-metal foams, but also ferrous metals or precious metals, can be manufactured as integral foams, i.e. with a continuous outer skin, near net shape in one step on a commercially available strip-casting installation, as a result of a small quantity of a solid blowing agent which releases gases being added to the liquid metal which is to be foamed, prior to rolling, and then pressure-forming the matrix in a roll stand to produce the desired final geometry. The flat profiled sections obtained using the process according to the invention comprise, in their interior, a microcellular integral foam with a high degree of homogeneity which is enclosed in a peripheral zone of solid metal which delimits the outer surfaces.

The porosity or density gradient over the profiled cross section of the metal strip obtained using the process according to the invention can be selected as desired within wide ranges by selecting different process parameters. By way of example both the quantity of flowing agent added and the gap width selected and/or the cooling rate which is predetermined by the heat control of the rolls may require the decomposition of the blowing agent to be adapted to the solidification process.

The solid blowing agent can be brought into contact with the metal melt in a very wide variety of ways. In the context of the present invention, it is particularly preferable for the blowing agent to be brought into contact with the metal melt by injection, scattering and/or flushing in of a metal wire which is filled with the blowing agent.

In terms of its decomposition temperature, the blowing agent should be adapted to the melting temperature of the casting material (metal melt). The decomposition must only commence at over 100° C. and should be no more than approximately 150° C. higher than the melting temperature.

The quantity of blowing agent to be used depends on the required conditions. Within the context of the present invention, it is particularly preferable for the blowing agent to be used in a quantity of from about 0.1 to about 10% by weight, in particular about 0.2 to about 1% by weight, based on the metal melt.

Blowing agents which release gases and are solid at room temperature include, in particular, light-metal hydrides, such as magnesium hydride. In the context of the present invention, autocatalytically produced magnesium hydride, which is marketed, for example, under the name TEGO Magnan® by the applicant, is particularly preferred within the context of the present invention. However, titanium hydride, carbonates, hydrates and/or volatile substances, which have already been used in the prior art to foam metals, can also be used in the same way.

Based on solid material, the proportion of metal in the metal body produced may be in the range from about 5 to about 95% by volume or % by weight, depending on the volume or thickness of the metal body, a lower volume to area ratio meaning higher degrees of filling.

Strip casting installations in the context of the present invention comprise in particular continuously operating installations for the near net shape casting of metals. Thin strip (roughed strip 15 to 50 mm, strip <15 mm, thin strip <5 mm) is produced directly from the melt in these installations. The processes usually operate with 1 or 2 rolls. In principle, they can be classified into two categories:

1st type: the melt solidifies on a single roll; the product obtained is a metal sheet with a thickness of 1 to 2 mm.

2nd type: the melt solidifies between 2 rolls (double roller); the strip thickness which can be achieved is between 1 and 6 mm, depending on the process.

The term "near net shape casting" is used as a broad term encompassing a continuous process for the direct casting of metal, in particular steel melt, to form thin slabs or strips. The direct meaning is: without hot rolling. Depending on the dimensions of the product produced during this deformation, specialists refer to thin slabs, roughed strip or strip. Compared to continuous casting, products produced in this way have a uniform solidification structure. While there is usually no center-line segregation during near net shape casting, the present invention results in metal foams with a hollow structure in the interior and a continuous outer surface. This is due in particular to the high solidification rate, which leaves little time for diffusion processes. To prevent oxidation of the metal, it is possible to encapsulate it under an inert-gas atmosphere from the application of metal through to the hot rolling which may be required.

The present invention results in particular in integral metal foam bodies with a strip thickness of from about 0.1 to about 15 mm, in particular 0.2 to 10 mm.

Metallographic examination of the microstructure of the metal sheets obtained using the process according to the invention demonstrates that the microcellular metal foam obtained is close to the ideal image of the bone of a mammal, the nature of which is predetermined and which in terms of its structure corresponds to an integral foam.

The following exemplary embodiment is intended to explain the process according to the invention and the metal foams obtained therewith.

EXAMPLE

Aluminum (99.9%) was heated in a crucible to approx. 780° C., and the molten metal was introduced, with the aid of a trowel, into the roll nip of a small strip-casing installation (strip width 40 mm, diameter of the casting roll 300 mm). Tego Magnan® magnesium hydride powder (98% hydride content) was applied uniformly, with the aid of a doctor blade, to one of the two unheated copper rolls and, as a result of the advance of the roll, was moved into the reservoir of molten aluminum upstream of the roll nip. The roll nip was set to 3 mm, and the feed rate to 0.2 m/s. A metal sheet with a thickness of approx. 0.7 mm left the roller frame and underwent metallographic examination after cooling.

The above description is intended to be illustrative and not limiting. Various changes and modifications in the embodiment described herein may occur to those skilled in the art. Those changes can be made without departing from the scope and spirit of the invention.

What is claimed is:

1. A process for producing a large-area integral metal foam in an apparatus comprising a roll nip and a roll stand said process comprising preparing a metal melt, introducing the metal melt into the roll nip while contacting the metal melt in the roll nip with a blowing agent, forming the metal melt in the roll stand and foaming the metal melt to form a large-area integral metal foam, whereby said blowing agent is solid at room temperature.

2. The process according to claim 1, wherein the blowing agent is brought into contact with the metal melt by injection, scattering, flushing with a metal wire, which is filled with the blowing agent, or a combination of the above.

3. The process according to claim 1, wherein the metal melt comprises a ferrous metal, a precious metal or a light metal.

4. The process according to claim 3, wherein the metal melt comprises aluminum or an alloy.

5. The process according to claim 1, wherein from about 0.1 to about 10% by weight, based on the metal melt, of the blowing agent is present.

6. The process according the claim 1, wherein from about 0.2 to about 1% by weight, based on the metal melt, of the blowing agent is present.

7. The process according to claim 1, wherein the blowing agent is a light metal hydride.

8. The process according to claim 7, wherein the light metal hydride is magnesium hydride.

9. The process according to claim 8 wherein the magnesium hydride is autocatalytically produced.

10. The process according to claim 7, wherein the light hydride is titanium hydride, a titanium carbonate, a titanium hydrate or a volatile substance containing titanium.

11. The process according to claim 1, wherein the apparatus is a strip-casting installation apparatus.

* * * * *